US009748681B1

(12) United States Patent
Champion et al.

(10) Patent No.: US 9,748,681 B1
(45) Date of Patent: Aug. 29, 2017

(54) GROUND CONTACT MODULE FOR A CONTACT MODULE STACK

(71) Applicant: TYCO ELECTRONICS CORPORATION, Berwyn, PA (US)

(72) Inventors: Bruce Allen Champion, Camp Hill, PA (US); Michael John Phillips, Camp Hill, PA (US); Michael Eugene Shirk, Grantville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/168,419

(22) Filed: May 31, 2016

(51) Int. Cl.
*H01R 13/648* (2006.01)
*H01R 12/72* (2011.01)
*H01R 13/6587* (2011.01)

(52) U.S. Cl.
CPC ..... *H01R 12/724* (2013.01); *H01R 13/6587* (2013.01)

(58) Field of Classification Search
CPC .. H01R 4/64; H01R 13/65802; H01R 23/688; H01R 13/7197; H01R 23/6873; H01R 13/514
USPC ..... 439/92, 95, 101, 108, 607.05–607.15, 439/607.35, 607.39
See application file for complete search history.

(56) References Cited

U.S. PATENT DOCUMENTS 7,566,247 B2 * 7/2009 Rothermel ..... H01R 23/688 439/108
7,824,197 B1 * 11/2010 Westman ..... H01R 13/6586 439/108
8,398,433 B1 * 3/2013 Yang ..... H01R 13/6587 439/108
8,480,413 B2 * 7/2013 Minich ..... H01R 12/724 439/607.05
8,540,525 B2 * 9/2013 Regnier ..... H01R 29/00 439/79
8,651,881 B2 * 2/2014 Regnier ..... H01R 29/00 439/108
8,764,483 B2 * 7/2014 Ellison ..... H01R 12/724 439/607.07
9,039,449 B2 * 5/2015 Zerebilov ..... H01R 12/7052 439/607.35
9,496,655 B1 * 11/2016 Huang ..... H01R 13/6585
2014/0127946 A1 5/2014 Ito et al.

* cited by examiner

*Primary Examiner* — Thanh Tam Le

(57) ABSTRACT

A ground contact module includes a ground leadframe and a ground dielectric body. The ground leadframe has ground contacts extending between corresponding mating ends and terminating ends with transition portions therebetween. The ground dielectric body holds the ground leadframe and has a low loss layer overmolded over the ground leadframe and encasing the transition portions of the ground contacts. The ground dielectric body has lossy wings received in pockets in the low loss layer. The lossy wings are electrically coupled to corresponding ground contacts and are manufactured from lossy material capable of absorbing electrical resonance propagating through the contact module stack. The lossy wings are separate and discrete from the low loss layer and are attached to the at least one low loss layer in proximity to the corresponding ground contacts. Each lossy wing is electrically coupled to only one of the ground contacts.

20 Claims, 4 Drawing Sheets

GROUND CONTACT MODULE FOR A CONTACT MODULE STACK

BACKGROUND OF THE INVENTION

The subject matter herein relates generally to communication connectors.

Some electrical connector systems utilize communication connectors to interconnect various components of the system for data communication. Some known communication connectors have performance problems, particularly when transmitting at high data rates. For example, the communication connectors typically utilize differential pair signal conductors to transfer high speed signals. Ground conductors improve signal integrity. However, electrical performance of known communication connectors, when transmitting the high data rates, is inhibited by noise from cross-talk and return loss. Such issues are more problematic with small pitch high speed data connectors, which are noisy and exhibit higher than desirable return loss due to the close proximity of signal and ground contacts. Energy from ground contacts on either side of the signal pair may be reflected in the space between the ground contacts and such noise results in reduced connector performance and throughput. The separation of the ground contacts often results in unfavorable resonances supported by the ground contacts at particular frequency bands. Costly methods using complex geometries of the signal and ground contacts have proven effective, but can overly complicate the design of the connector and may be impractical.

A need remains for a high density, high speed electrical connector assembly that reduces unwanted resonances supported by ground contacts in targeted frequency bands.

BRIEF DESCRIPTION OF THE INVENTION

In an embodiment, a ground contact module is provided including a ground leadframe having ground contacts extending between corresponding mating ends and terminating ends thereof with transition portions between the mating ends and the terminating ends. The transition portions are generally planar between a first side and a second side of the ground leadframe. The ground contact module includes a ground dielectric body holding the ground leadframe. The ground dielectric body has at least one low loss layer overmolded over the ground leadframe and encasing the transition portions of the ground contacts. The at least one low loss layer defines pockets. The ground dielectric body has lossy wings received in corresponding pockets. The lossy wings are electrically coupled to corresponding ground contacts. The lossy wings are manufactured from lossy material capable of absorbing electrical resonance propagating through the contact module stack. The lossy wings are separate and discrete from the at least one low loss layer and being attached to the at least one low loss layer in proximity to the corresponding ground contacts. Each lossy wing is electrically coupled to only one of the ground contacts.

In another embodiment, a contact module stack is provided including first and second signal contact modules each including a corresponding first and second signal leadframe and a corresponding first and second signal dielectric body holding the corresponding first and second signal leadframe. The first and second signal leadframes each have plural signal contacts extending between mating ends and terminating ends with transition portions between the mating and terminating ends. The first and second signal dielectric bodies substantially enclose the transition portions. The contact module stack includes first and second ground contact modules flanking the first and second signal contact modules such that the contact module stack has a ground-signal-signal-ground contact module arrangement. The first and second ground contact modules each include a corresponding first and second ground leadframe and a corresponding first and second ground dielectric body holding the corresponding first and second ground leadframe. The first and second ground leadframes each have ground contacts extending between corresponding mating ends and terminating ends with transition portions between the mating ends and the terminating ends. The first ground dielectric body has a first low loss layer defining pockets and first lossy wings received in corresponding pockets and being electrically coupled to corresponding ground contacts of the first ground leadframe. Each first lossy wing is electrically coupled to only one of the ground contacts of the first ground leadframe. The second ground dielectric body has a second low loss layer having pockets and second lossy wings received in corresponding pockets and being electrically coupled to corresponding ground contacts of the second ground leadframe. Each second lossy wing is electrically coupled to only one of the ground contacts of the second ground leadframe. The first and second lossy wings are manufactured from lossy material capable of absorbing electrical resonance propagating through the contact module stack.

In a further embodiment, a communication connector is provided including a housing having a mating end and a loading end with a cavity open at the loading end and a contact module stack loaded into the cavity of the housing through the loading end. The contact module stack includes at least one signal contact module including a signal leadframe and a dielectric body holding the signal leadframe. The signal leadframe has plural signal contacts extending between mating ends and terminating ends with transition portions between the mating and terminating ends. The dielectric body substantially encloses the transition portions. The contact module stack includes at least one ground contact module stacked adjacent the at least one signal contact module. The at least one ground contact module includes a ground leadframe and a ground dielectric body holding the ground leadframe. The ground leadframe has ground contacts extending between mating ends and terminating ends with transition portions between the mating ends and the terminating ends. The ground dielectric body has at least one low loss layer with pockets and lossy wings received in corresponding pockets and being electrically coupled to corresponding ground contacts. The lossy wings are manufactured from lossy material capable of absorbing electrical resonance propagating through the contact module stack. The lossy wings are separate and discrete from the at least one low loss layer and are attached to the at least one low loss layer in proximity to the corresponding ground contacts. Each lossy wing is electrically coupled to only one of the ground contacts.

DETAILED DESCRIPTION OF THE INVENTION

Figure 1:
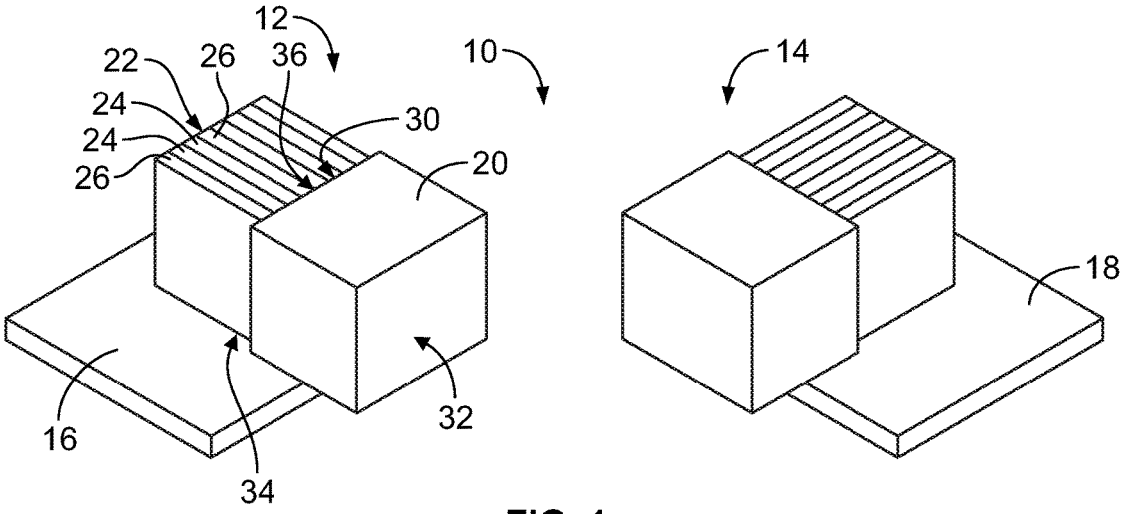
FIG. 1 is a schematic view of an electrical connector system formed in accordance with an embodiment.

FIG. 1 is a schematic view of an electrical connector system 10 formed in accordance with an embodiment. The electrical connector system 10 includes a first communication connector 12 and a second communication connector 14 that are configured to be directly mated together. The electrical connector system 10 may be disposed on or in an electrical component, such as a server, a computer, a router, or the like.

In an exemplary embodiment, the first communication connector 12 and the second communication connector 14 are configured to be electrically connected to respective first and second circuit boards 16, 18. The first and second communication connectors 12, 14 are utilized to provide a signal transmission path to electrically connect the circuit boards 16, 18 to one another at a separable mating interface.

The communication connector 12 includes a housing 20 holding a contact module stack 22 comprising a plurality of signal contact modules 24 and a plurality of ground contact modules 26 in a stacked arrangement. The contact modules 24, 26 may be wafers. In an exemplary embodiment, the signal and ground contact modules 24, 26 are arranged in a ground-signal-signal-ground (GSSG) arrangement with pairs of signal contact modules 24 flanked by ground contact modules 26. The signal contact modules 24 have pairs of contacts (for example, arranged in differential pairs) and the ground contact modules 26 provide shielding for the signal contact modules 24. Optionally, the signal contact modules 24 are high-speed signal contact modules transmitting high speed data signals. Optionally, at least some of the signal contact modules 24 may be low-speed signal contact modules transmitting lower speed signals, such as control signals. The housing 20 includes multiple walls that define a cavity 30 that receives the contact module stack 22. The housing 20 extends between a mating end 32 and a loading end 36. The cavity 30 is open at the loading end 36 to receive the contact module stack 22. The contact module stack 22 defines a mounting end 34 which is mounted to the circuit board 16.

In an exemplary embodiment, the contact module stack 22 includes lossy material configured to absorb at least some resonance that propagates along the current paths defined by the signal contacts and/or the ground contacts through the communication connector 12. For example, the lossy material may be provided in the ground contact modules 26. The lossy material provides electric and/or magnetic lossiness through a portion of the communication connector 12. The lossy material is able to conduct electrical energy at very low levels. The lossy material is less conductive than traditional conductive material, such as the conductive material of the contacts, and more conductive than the low loss dielectrics. The lossy material may be designed to provide electrical loss in a certain, targeted frequency range. The lossy material may include conductive particles (or fillers) dispersed within a dielectric (binder) material. The dielectric material, such as a polymer or epoxy, is used as a binder to hold the conductive particle filler elements in place. These conductive particle filler elements then impart loss that converts the dielectric material to a lossy material. In some embodiments, the lossy material is formed by mixing binder with filler that includes conductive particles. Examples of conductive particles that may be used as a filler to form electrically lossy materials include but are not limited to carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles.

As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of communication connectors. The thermoplastic material may be molded, such as molding of the ground contact modules 26 into the desired shape and/or location. However, many alternative forms of binder materials may be used. Curable materials, such as epoxies, can serve as a binder. Alternatively, materials such as thermosetting resins or adhesives may be used.

Optionally, the communication connector 14 may be similar to the communication connector 12. For example, the communication connector 14 may include a contact module stack similar to the contact module stack 22 and may include ground contact modules with lossy material. In other various embodiments, the communication connector 14 may be another type of connector. For example, the communication connector 14 may be a high speed transceiver module having a circuit card configured to mate with the communication connector 12. In such embodiments, the communication connector 14 does not include a contact module stack.

Figure 2:
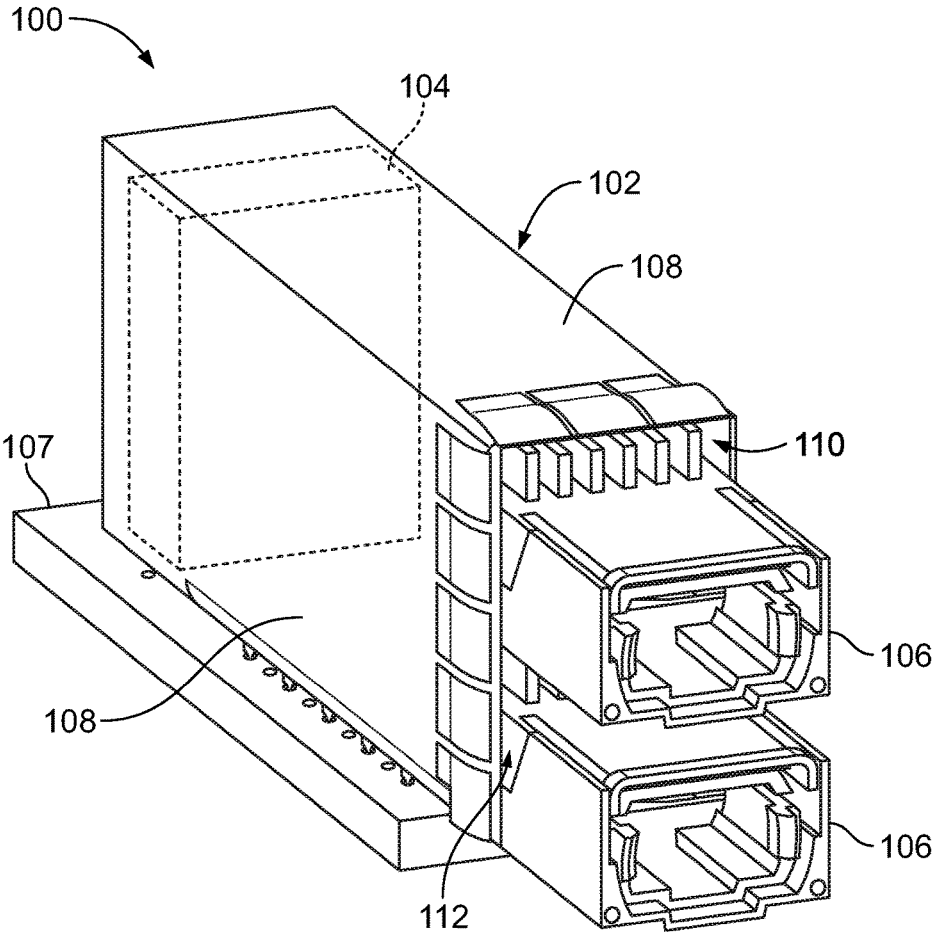
FIG. 2 is a front perspective view of an electrical connector assembly formed in accordance with an exemplary embodiment.

FIG. 2 is a front perspective view of an electrical connector assembly 100 formed in accordance with an exemplary embodiment. The electrical connector assembly 100 includes a cage member 102 and a communication connector 104 (shown schematically in FIG. 2, also illustrated in FIG. 3) disposed in the cage member 102. Pluggable modules 106 are loaded into the cage member 102 for mating with the communication connector 104. The cage member 102 and the communication connector 104 are intended for placement on and electrical connection to a circuit board 107, such as a motherboard. The communication connector 104 is arranged within the cage member 102 for mating engagement with the pluggable modules 106. In an exemplary embodiment, the pluggable module 106 includes a circuit card (not shown) configured to be plugged into the communication connector 104.

The cage member 102 is a shielding, stamped and formed cage member that includes a plurality of shielding walls 108 that define multiple ports 110, 112 for receipt of the pluggable modules 106. In the illustrated embodiment, the cage member 102 constitutes a stacked cage member having the ports 110, 112 in a stacked configuration. Any number of ports may be provided in alternative embodiments. In the illustrated embodiment, the cage member 102 includes the ports 110, 112 arranged in a single column, however, the cage member 102 may include multiple columns of ganged ports 110, 112 in alternative embodiments (for example, 2×2, 3×2, 4×2, 4×3, etc.). The communication connector 104 is configured to mate with the pluggable modules 106 in both stacked ports 110, 112. Optionally, multiple communication connectors 104 may be arranged within the cage member 102, such as when multiple ports are provided.

Figure 3:
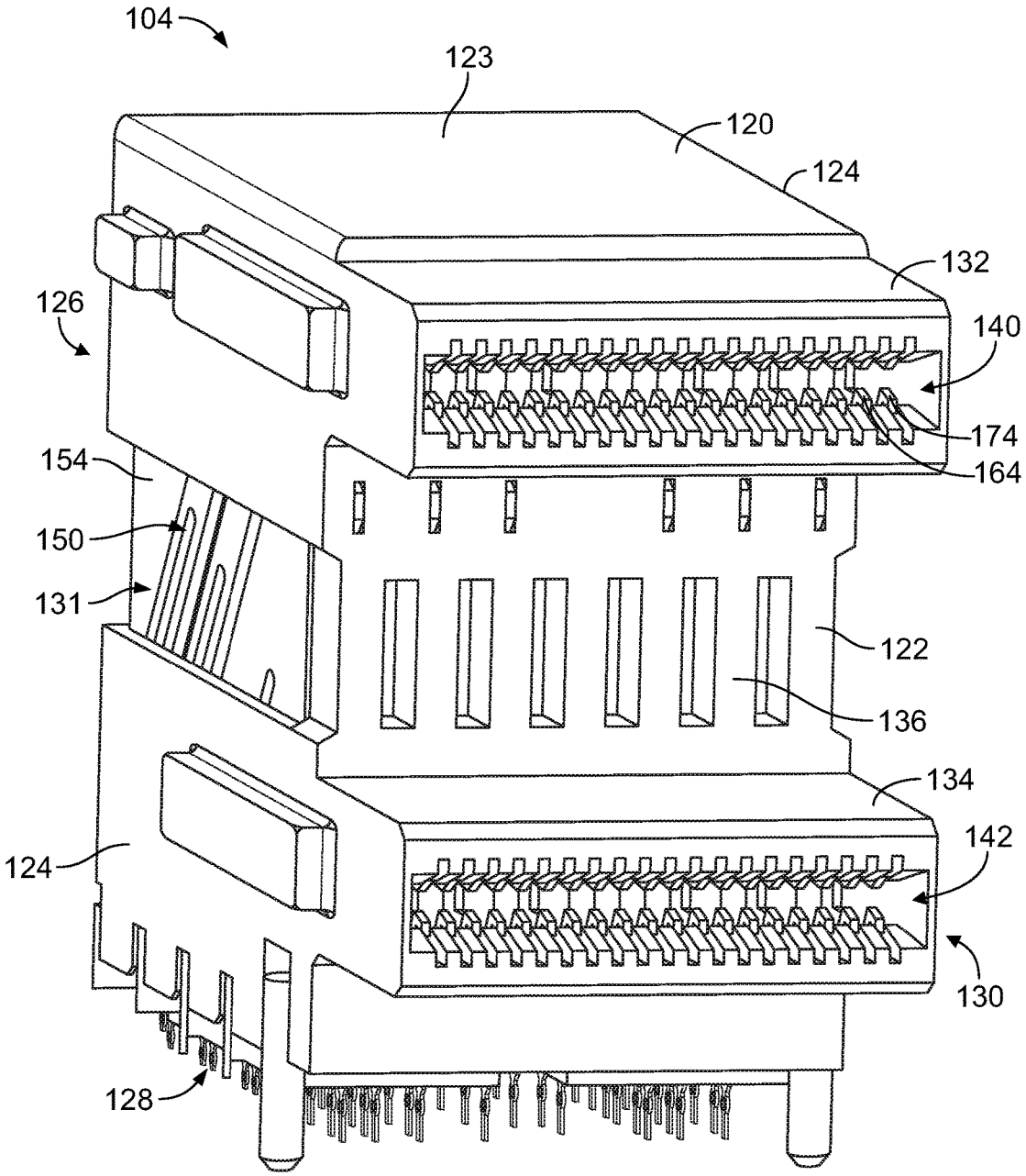
FIG. 3 is a front perspective view of a communication connector of the electrical connector assembly in accordance with an exemplary embodiment.

FIG. 3 is a front perspective view of the communication connector 104 in accordance with an exemplary embodiment. The communication connector 104 includes a housing 120 holding a contact module stack 150. The housing 120 is defined by an upstanding body portion 122 having a top 123, sides 124, a loading end 126, a mounting end 128 configured to be mounted to the circuit board 107 (shown in FIG. 2), and a mating end 130. In the illustrated embodiment, the mating end 130 is located at a front, the loading end 126 is located at the rear opposite the mating end 130, and the mounting end 128 is located at a bottom of the housing 120; however, other configurations are possible in alternative embodiments. The body portion 122 may be molded from a dielectric material, such as a plastic material, to form the housing 120. The housing 120 has a cavity 131 open at the loading end 126 configured to receive the contact module stack 150.

Upper and lower extension portions 132 and 134 extend from the body portion 122 to define a stepped mating face. A recessed face 136 is provided between the extension portions 132, 134. For a single port cage member, the communication connector 104 may only include a single extension portion. Mating slots 140 and 142, such as circuit card receiving slots, extend inwardly from the mating face of the respective upper and lower extension portions 132, 134, and extend inwardly to the body portion 122. The mating slots 140, 142 are configured to receive mating components, such as plug connectors, card edges of circuit cards of the corresponding pluggable modules 106 (shown in FIG. 2), or another type of mating component. A plurality of contacts 164, 174 of the contact module stack 150 are exposed within the mating slots 140, 142 for mating with contact pads on the card edge of the corresponding pluggable module 106. The contacts 164, 174 have tails that extend from the mounting end 128 for termination to the circuit board 107. For example, the tails of the contacts 164, 174 may constitute pins that are received in plated vias of the circuit board 107. Alternatively, the tails of the contacts 164, 174 may be terminated to the circuit board 107 in another manner, such as by surface mounting to the circuit board 107.

The contact module stack 150 includes signal contact modules 152 (shown in FIG. 7) and ground contact modules 154 providing electrical shielding for the signal contact modules 152. Optionally, the ground contact modules 154 may flank and be positioned between pairs of signal contact modules 152, such as in a ground-signal-signal-ground (GSSG) contact module arrangement. Any number of signal and ground contact modules 152, 154 may be provided in the contact module stack 150 and may be positioned in any order. The signal contact modules 152 each include a signal leadframe 160 (shown in FIG. 7) and a signal dielectric body 162 (shown in FIG. 7). The ground contact modules 154 each include a ground leadframe 170 (shown in FIG. 4) and a ground dielectric body 172 (shown in FIG. 4).

In an exemplary embodiment, each ground dielectric body 172 includes lossy material configured to absorb at least some electrical resonance that propagates along the signal leadframe 160 and/or the ground leadframe 170. For example, the lossy material may form part of the ground dielectric body 172. In an exemplary embodiment, the ground dielectric body 172 includes lossy wings extending from one or more edges of the ground conductors and that are attached to other portions of the ground dielectric body 172. The lossy material provides electric and/or magnetic lossiness through a portion of the ground contact module 154. The lossy material is able to conduct electrical energy at very low levels. The lossy material is less conductive than conductive material, such as the conductive material of the ground leadframe 170. The lossy material may be designed to provide electrical loss in a certain, targeted frequency range. The lossy material may include conductive particles (or fillers) dispersed within a dielectric (binder) material. The dielectric material, such as a polymer or epoxy, is used as a binder to hold the conductive particle filler elements in place. These conductive particle filler elements then impart loss that converts the dielectric material to lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles.

Figure 4:
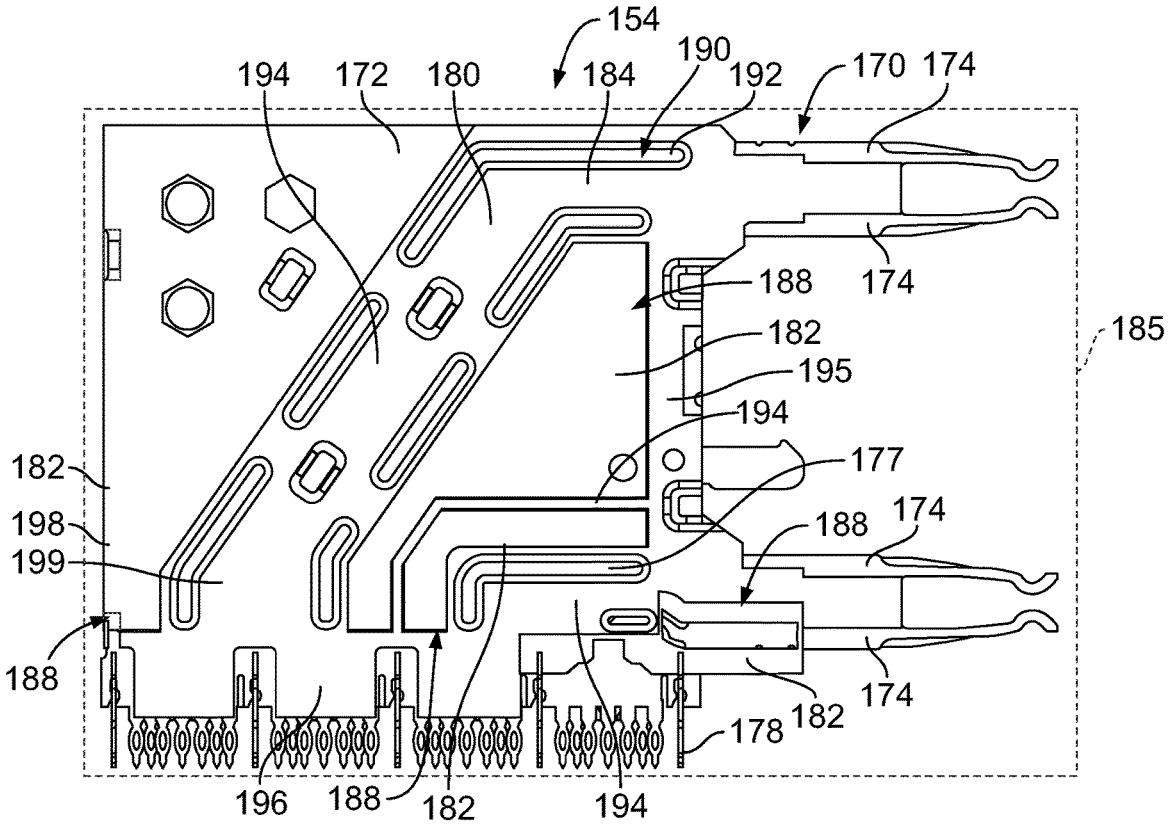
FIG. 4 is a side view of a ground contact module of the communication connector in accordance with an exemplary embodiment.
Figure 5:
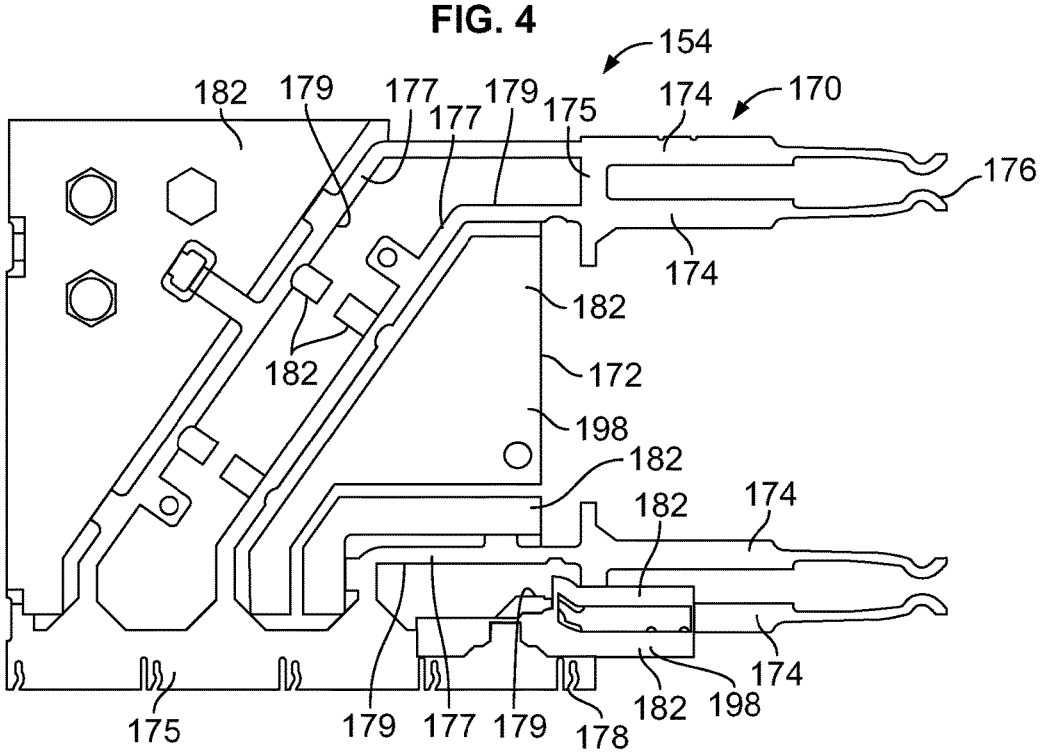
FIG. 5 is a side view of a portion of the ground contact module.
Figure 6:
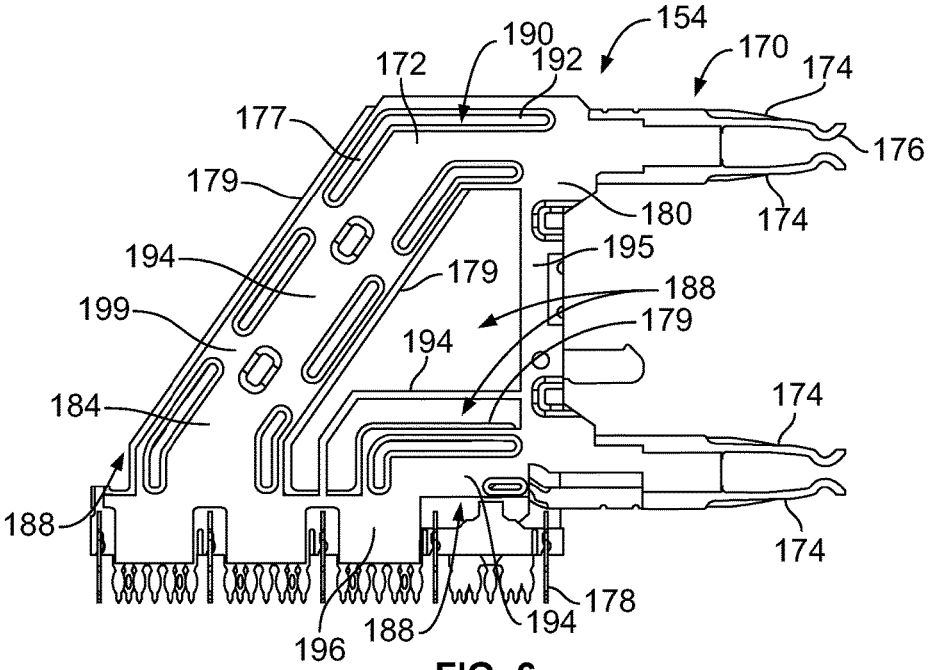
FIG. 6 is a side view of another portion of the ground contact module.

FIG. 4 is a side view of the ground contact module 154 in accordance with an exemplary embodiment. FIG. 5 is a side view of a portion of the ground contact module 154. FIG. 6 is a side view of another portion of the ground contact module 154. The ground leadframe 170 includes ground contacts 174, which may be connected to other (for example, adjacent) ground contacts 174 by bridge sections 175. Each ground contact 174 extends between a mating end 176 and a terminating end 178 with a transition portion 177 between the mating and terminating ends 176, 178. The bridge sections 175 may be proximate to the mating ends 176 and/or the terminating ends 178. The ground contacts 174 have edges 179 formed by peripheral surfaces that connect opposite sides of the ground contacts 174. Opposing edges 179 of adjacent ground contacts 174 face each other across gaps. In the illustrated embodiment, the mating end 176 is at the front of the ground contact module 154 and the terminating end 178 is at the bottom of the contact module 154. The transition portion 177 transitions 90° between the mating and terminating ends 176, 178. Other configurations are possible in alternative embodiments. The mating end 176 is configured to mate with the pluggable module 106 (shown in FIG. 2), such as with the circuit card of the pluggable module 106. The terminating end 178 is configured to be terminated to the circuit board 107 (shown in FIG. 2), such as using compliant pins press-fit into plated vias of the circuit board 107 or surface tails surface-mounted to the circuit board 107. The terminating ends 178 may be terminated in other ways to the circuit board, or may be terminated to another component such as ends of wires or cables. The terminating ends 178 may include separate contacts terminated to the ground leadframe 170.

The ground dielectric body 172 encases the ground leadframe 170, such as the transition portions 177. In an exemplary embodiment, the mating ends 176 extend forward of the ground dielectric body 172 and the terminating ends 178 extend below the ground dielectric body 172. The ground dielectric body 172 may be an overmolded dielectric body overmolded over the ground leadframe 170. Alternatively, the ground dielectric body 172 may be pre-molded pieces coupled together around the ground leadframe 170.

In an exemplary embodiment, the ground dielectric body 172 includes lossy material. For example, the ground dielectric body 172 includes at least one low loss layer 180 (FIG. 6) and at least one lossy wing 182 (FIG. 5) attached to the low loss layer 180. The lossy wing 182 is manufactured from lossy material, such as lossy material having conductive particles in a dielectric binder material, which absorbs and dissipates electrical resonance propagating through the ground contact module 154. The lossy material has dielectric properties that vary with frequency. The low loss layer 180 is manufactured from a low loss dielectric material, such as a plastic material. The low loss dielectric material has dielectric properties that have relatively little variation with frequency.

The low loss layer(s) 180 are provided on a first side 184 and on a second side 186 (shown in FIG. 7) of the ground dielectric body 172. Optionally, the ground leadframe 170 may be generally planar along a ground leadframe plane between the first and second sides 184, 186. For example, the mating and terminating ends 176, 178 and the transition portions 177 may be generally planar between the first sides and the second sides thereof. The low loss layer(s) 180 may be overmolded over the ground leadframe 170 and form an overmold dielectric layer on the ground leadframe 170. The low loss layer 180 substantially encloses the transition portions 177 of the ground contact(s) 174. For example, the low loss layer 180 may be molded around the first and second sides of the transition portions 177 and may be molded around edges 179 of the transition portions 177. The low loss layer 180 may be molded around the bridge sections 175.

In an exemplary embodiment, the low loss layer(s) 180 define pockets 188 between the first and second sides 184, 186. The pockets 188 receive corresponding lossy wings 182. The pockets 188 may expose portions of the ground contacts 174, such as the edges 179 of the transition portions 177. The low loss layer(s) 180 includes a plurality of windows 190 that expose the ground contact(s) 174 to air and define exposed surfaces 192 of the ground contact(s) 174. The windows 190 may be formed by pinch-points of the ground leadframe 170 during overmolding. The windows 190 may be sized and shaped to affect the electrical characteristics of the ground contact(s) 174 by exposing such portions to air.

In the illustrated embodiment, the ground dielectric body 172 includes a plurality of the lossy wings 182. Each lossy wing 182 is a separate and discrete piece from the low loss layer 180. The lossy wings 182 may be molded in situ in the pockets 188. For example, the lossy wings 182 may be formed with the low loss layer 180 in a multistage overmolding process (for example, a two shot overmolding process). Alternatively, the lossy wings 182 may be pre-molded and inserted into the pockets 188 and coupled to the low loss layer 180. For example, the lossy wings 182 may be secured to the low loss layer 180, such as by a friction fit, by being laminated or adhered to the low loss layer 180, by securing features (for example, posts and holes) formed in or on the lossy wings 182 and the low loss layer 180, by using separate securing features such as clips, or by other securing means.

The lossy wings 182 are electrically coupled to the corresponding ground contacts 174. Each lossy wing 182 may be directly electrically coupled to the corresponding ground contact 174. Alternatively, the lossy wing 182 may be indirectly electrically coupled to the corresponding ground contact 174, such as by capacitive coupling. The lossy wing 182 may be coupled to the ground contact 174 at one of the edges 179 and may extend from the edge 179 into the gap between the ground contact 174 and the adjacent ground contact 174. The lossy wing 182 may extend outward from the edge 179 of the ground contact 174 into, and optionally entirely through, the ground leadframe plane of the corresponding ground contact 174. Optionally, one or more of the ground contacts 174 may have lossy wings 182 electrically coupled to opposite edges 179 thereof extending in opposite directions.

In an exemplary embodiment, each lossy wing 182 is coupled to only one ground contact 174. Bridges 194 of the low loss layer 180 are provided between the lossy wings 182 to isolate the lossy wings 182 from each other. The bridges 194 may be coupled to corresponding ground contacts 174, or alternatively, may be provided in the gaps between the ground contacts 174. The bridges 194 extend between first and second lands 195, 196 to enclose the pockets 188. For example, the first land 195 may be at the front of the ground dielectric body 172 proximate to the mating ends 176 of the ground contacts 174, while the second land 196 may be at the bottom of the ground dielectric body 172 proximate to the terminating ends 178. The pockets 188 between the lands 195, 196 and the bridges 194 allow the lossy wings 182 to be recessed into the ground dielectric body 172. In an exemplary embodiment, outer surfaces 198 of the lossy wings 182 may be generally coplanar with outer surfaces 199 of the low loss layer 180 at the first side 184 and/or the second side 186.

Electrical performance of the communication connector 104 is enhanced by the inclusion of the lossy material in the ground contact modules 154. For example, at various data rates, including high data rates, return loss is inhibited by the lossy wings 182. For example, the return loss of the small pitch, high speed data of the contact module stack 150 due to the close proximity of signal and ground contacts 164, 174 is reduced by the lossy wings 182. For example, energy from the ground contacts 174 on either side of the signal pair reflected in the space between the ground contacts 174 is absorbed, and thus connector performance and throughput are enhanced.

Figure 7:
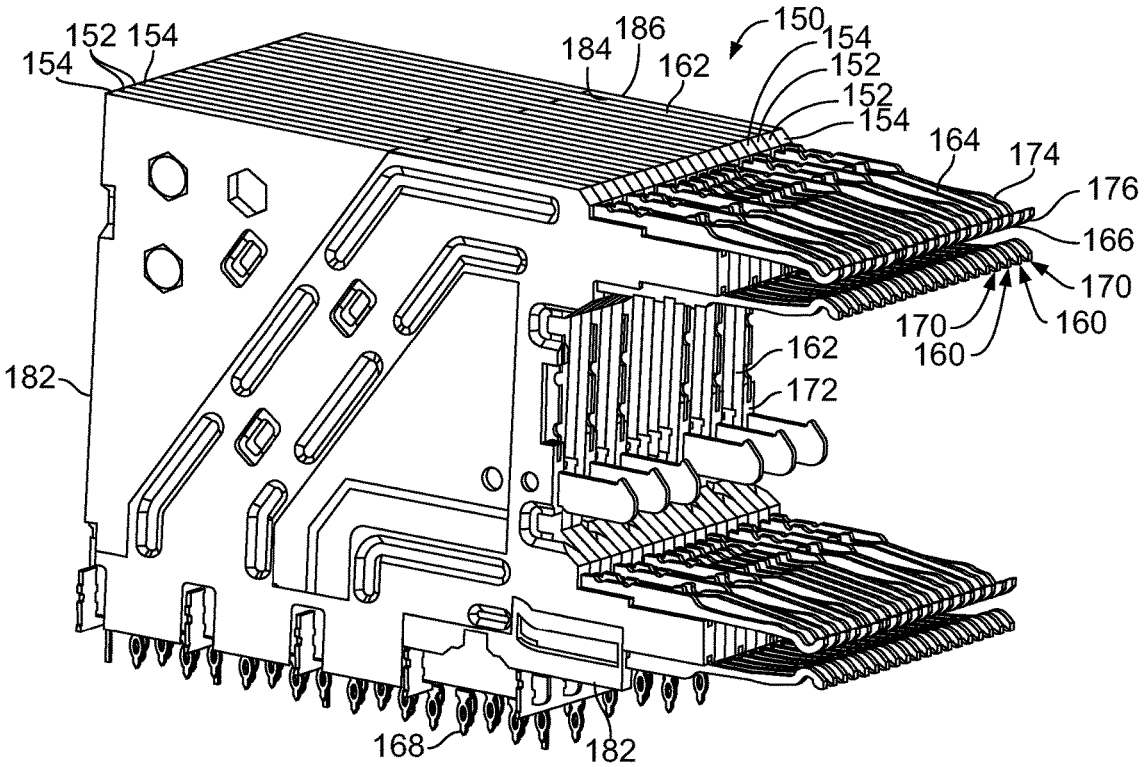
FIG. 7 is a perspective view of a portion of a contact module stack of the communication connector.

FIG. 7 is a perspective view of a portion of the contact module stack 150 showing ground contact modules 154 flanking signal contact modules 152. In the illustrated embodiment, the contact module arrays are shown in a GSSGSSG arrangement of the ground contact modules 154 and signal contact modules 152. Any number of the signal and ground contact modules 152, 154 may be stacked together.

The signal leadframe 160 includes at least one signal contact 164 extending between a mating end 166 and terminating end 168 with a transition portion between the mating and terminating ends 166, 168. In the illustrated embodiment, the mating end 166 is at the front of the signal contact module 152 and the terminating end 168 is at the bottom of the signal contact module 152. The transition portion transitions 90° between the mating and terminating ends 166, 168. Other configurations are possible in alternative embodiments. The signal leadframes 160 may be stacked adjacent the ground leadframes 170 with the mating ends 166 aligned with the mating ends 176 for mating with the pluggable module 106 (shown in FIG. 2), such as with the circuit card of the pluggable module 106. The terminating end 168 is configured to be terminated to the circuit board 107 (shown in FIG. 2), such as using compliant pins press-fit into plated vias of the circuit board 107 or surface tails surface-mounted to the circuit board 107. The terminating ends 168 may be terminated in other ways to the circuit board, or may be terminated to another component such as ends of wires or cables.

The signal dielectric body 162 encases the transition portions of the signal leadframe 160. The signal dielectric body 162 may be an overmolded dielectric body overmolded over the signal leadframe 160. Alternatively, the signal dielectric body 162 may be pre-molded pieces coupled together around the signal leadframe 160. The signal dielectric body 162 may be manufactured entirely from low loss dielectric material. The signal dielectric body 162 may abut against the adjacent ground dielectric body 172.

When the contact module stack 150 is assembled, the ground contact modules 154 provide electrical shielding for the signal contact modules 152. The conductive ground contacts 174 provide electrical shielding to shield the pairs of signal contacts 164 from other pairs of signal contacts 164, such as signal contacts in another part of the contact module stack 150. The electrical shielding improves electrical performance of the communication connector 104 (shown in FIG. 3). The lossy material of the lossy wings 182 further improves electrical performance of the communication connector 104 by absorbing electrical resonance propagating through the contact module stack 150. The lossy material lowers the energy reflected along the signal and/or ground contacts 174, 164, thus improving performance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A ground contact module comprising:

a ground leadframe having ground contacts extending between corresponding mating ends and terminating ends thereof with transition portions between the mating ends and the terminating ends, the transition portions being generally planar between a first side and a second side of the ground leadframe; and a ground dielectric body holding the ground leadframe, the ground dielectric body having at least one low loss layer overmolded over the ground leadframe and encasing the transition portions of the ground contacts, the at least one low loss layer defining pockets, the ground dielectric body having lossy wings received in corresponding pockets, the lossy wings being electrically coupled to corresponding ground contacts, the lossy wings being manufactured from lossy material capable of absorbing electrical resonance propagating through a contact module stack, the lossy wings being separate and discrete from the at least one low loss layer and being attached to the at least one low loss layer in proximity to the corresponding ground contacts, wherein each lossy wing is electrically coupled to only one of the ground contacts.

2. The ground contact module of claim 1, wherein the lossy wing directly engages the corresponding ground contact.

3. The ground contact module of claim 1, wherein the lossy wing extends outward from an edge of the ground contact into a ground leadframe plane of the corresponding ground contact.

4. The ground contact module of claim 1, wherein the lossy wing includes an outer surface coplanar with an outer surface of the low loss layer.

5. The ground contact module of claim 1, wherein the low loss layer includes bridges between adjacent pockets to separate the pockets and the corresponding lossy wings.

6. The ground contact module of claim 1, wherein the low loss layer includes bridges extending between first and second lands at the mating and terminating ends, respectively, the bridges separate pockets from each other, the bridges separate adjacent lossy wings from each other.

7. The ground contact module of claim 1, wherein at least one of the ground contacts includes the lossy wings electrically coupled thereto on opposite edges of the corresponding ground contact.

8. The ground contact module of claim 1, wherein a plurality of the ground contacts are tied together by bridge sections of the ground leadframe.

9. The ground contact module of claim 1, wherein the ground contacts include a first ground contact and a second ground contact, the lossy wings include a first lossy wing and a second lossy wing, the first and second lossy wings being positioned between the first and second ground contacts, a bridge of the low loss layer being positioned between the first and second wings to isolate the first and second wings from each other.

10. A contact module stack comprising:

first and second signal contact modules each including a corresponding first and second signal leadframe and a corresponding first and second signal dielectric body holding the corresponding first and second signal leadframe, the first and second signal leadframes each having plural signal contacts extending between mating ends and terminating ends with transition portions between the mating and terminating ends, the first and second signal dielectric bodies substantially enclosing the transition portions; and first and second ground contact modules flanking the first and second signal contact modules such that the contact module stack has a ground-signal-signal-ground contact module arrangement, the first and second ground contact modules each including a corresponding first and second ground leadframe and a corresponding first and second ground dielectric body holding the corresponding first and second ground leadframe, the first and second ground leadframes each having ground contacts extending between corresponding mating ends and terminating ends with transition portions between the mating ends and the terminating ends, the first ground dielectric body having a first low loss layer defining pockets and first lossy wings received in corresponding pockets and being electrically coupled to corresponding ground contacts of the first ground leadframe, wherein each first lossy wing is electrically coupled to only one of the ground contacts of the first ground leadframe, the second ground dielectric body having a second low loss layer having pockets and second lossy wings received in corresponding pockets and being electrically coupled to corresponding ground contacts of the second ground leadframe, wherein each second lossy wing is electrically coupled to only one of the ground contacts of the second ground leadframe;

wherein the first and second lossy wings are manufactured from lossy material capable of absorbing electrical resonance propagating through the contact module stack.

11. The contact module stack of claim 10, wherein the first lossy wings directly engage the corresponding ground contacts of the first ground leadframe.

12. The contact module stack of claim 10, wherein the first lossy wings extend outward from edges of the corresponding ground contacts of the first ground leadframe into a ground leadframe plane of the first ground leadframe.

13. The contact module stack of claim 10, wherein the first lossy wings include outer surfaces coplanar with an outer surface of the first low loss layer.

14. The contact module stack of claim 10, wherein the first low loss layer includes bridges between adjacent pockets to separate the pockets and the corresponding first lossy wings.

15. The contact module stack of claim 10, wherein the first low loss layer includes bridges extending between first and second lands at the mating and terminating ends, respectively, the bridges separate pockets from each other, the bridges separate adjacent first lossy wings from each other.

16. The contact module stack of claim 10, wherein at least one of the ground contacts of the first ground leadframe includes the first lossy wings electrically coupled thereto on opposite edges of the corresponding ground contact.

17. A communication connector comprising:

a housing having a mating end and a loading end, the housing having a cavity open at the loading end; and a contact module stack loaded into the cavity of the housing through the loading end, the contact module stack comprising:

at least one signal contact module including a signal leadframe and a dielectric body holding the signal leadframe, the signal leadframe having plural signal contacts extending between mating ends and terminating ends with transition portions between the mating and terminating ends, the dielectric body substantially enclosing the transition portions; and at least one ground contact module stacked adjacent the at least one signal contact module, the at least one ground contact module including a ground leadframe and a ground dielectric body holding the ground leadframe, the ground leadframe having ground contacts extending between mating ends and terminating ends with transition portions between the mating ends and the terminating ends, the ground dielectric body having at least one low loss layer with pockets and lossy wings received in corresponding pockets and being electrically coupled to corresponding ground contacts, the lossy wings being manufactured from lossy material capable of absorbing electrical resonance propagating through the contact module stack, the lossy wings being separate and discrete from the at least one low loss layer and being attached to the at least one low loss layer in proximity to the corresponding ground contacts, wherein each lossy wing is electrically coupled to only one of the ground contacts.

18. The communication connector of claim 17, wherein the lossy wing directly engages the corresponding ground contact.

19. The communication connector of claim 17, wherein the lossy wing extends outward from an edge of the ground contact into a ground leadframe plane of the ground contacts.

20. The communication connector of claim 17, wherein the low loss layer includes bridges between adjacent pockets to separate the pockets and the corresponding lossy wings.

* * * * *